US008525729B1

(12) United States Patent
Martin

(10) Patent No.: US 8,525,729 B1
(45) Date of Patent: Sep. 3, 2013

(54) ANTENNA TILES WITH GROUND CAVITIES INTEGRATED INTO SUPPORT STRUCTURE

(75) Inventor: Bonnie G. Martin, Lumberton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 784 days.

(21) Appl. No.: 12/636,189

(22) Filed: Dec. 11, 2009

Related U.S. Application Data

(60) Provisional application No. 61/143,720, filed on Jan. 9, 2009.

(51) Int. Cl.
*H01Q 1/38* (2006.01)

(52) U.S. Cl.
USPC ..... 343/700 MS; 343/846

(58) Field of Classification Search
USPC ..... 343/700 MS, 844, 825, 826, 827, 343/846
See application file for complete search history.

(56) References Cited

U.S. PATENT DOCUMENTS

| | | | | |
|---|---|---|---|---|
| 4,937,585 | A * | 6/1990 | Shoemaker | 343/700 MS |
| 5,227,749 | A * | 7/1993 | Raguenet et al. | 333/246 |
| 6,087,989 | A * | 7/2000 | Song et al. | 343/700 MS |
| 6,999,032 | B2 * | 2/2006 | Pakray et al. | 343/713 |
| 7,268,729 | B1 * | 9/2007 | Yang | 343/700 MS |
| 2006/0017616 | A1 * | 1/2006 | Hsu et al. | 343/700 MS |
| 2006/0202312 | A1 * | 9/2006 | Iijima et al. | 257/664 |
| 2009/0015485 | A1 * | 1/2009 | Floyd et al. | 343/700 MS |

* cited by examiner

*Primary Examiner* — Dieu H Duong
(74) *Attorney, Agent, or Firm* — McDermott Will & Emery LLP

(57) ABSTRACT

Examples of an antenna tile and a method of manufacturing the same are provided. An antenna tile may include one or more antenna patch elements, a circuit board, and a support structure. The one or more antenna patch elements may radiate radio frequency (RF) signals, and each of the one or more antenna patch elements may include a conductive layer. The circuit board may be disposed between the one or more antenna patch elements and the support structure. The support structure may include one or more ground cavities. The one or more ground cavities may be integrated into the support structure and may be electrically conductive. The one or more ground cavities may resonate standing waves, and the one or more ground cavities may be disposed below the respective one or more antenna patch elements.

12 Claims, 14 Drawing Sheets

FIG. 1A
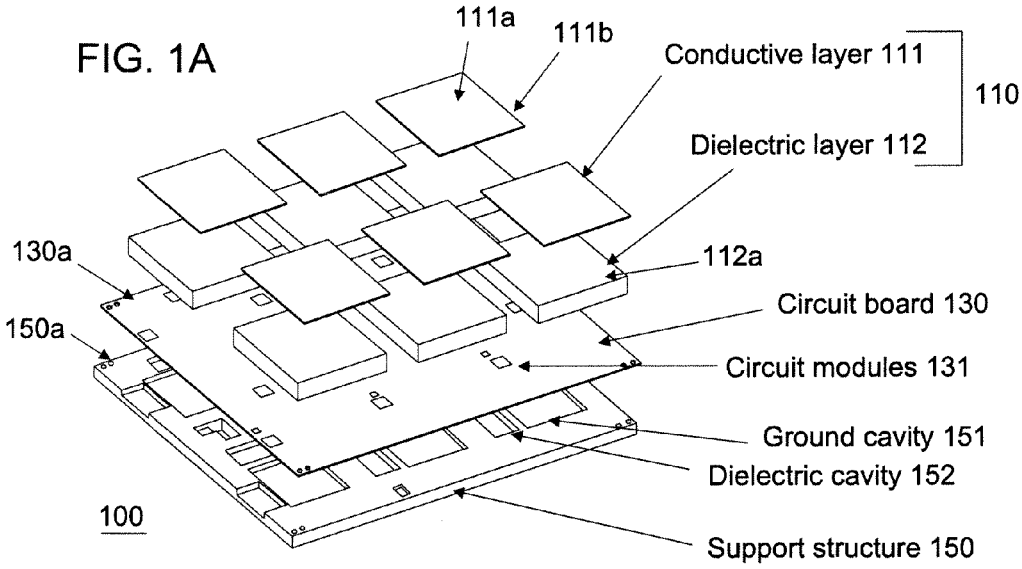
FIG. 1B
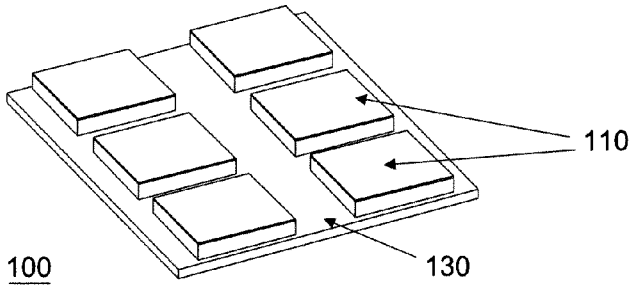
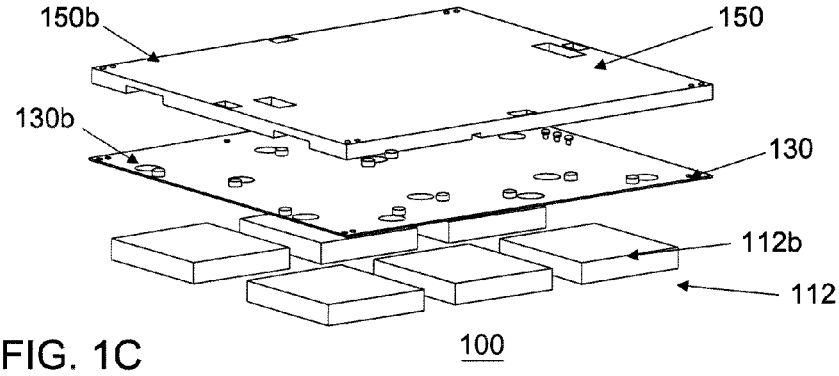
FIG. 1C

ANTENNA TILES WITH GROUND CAVITIES INTEGRATED INTO SUPPORT STRUCTURE

CROSS-REFERENCE TO RELATED APPLICATION

The present application claims the benefit of priority under 35 U.S.C. §119 from U.S. Provisional Patent Application Ser. No. 61/143,720, entitled "LOW COST LOW MASS RF-ON-FLEX L-BAND PHASED ARRAY SPACE TILE," filed on Jan. 9, 2009, which is hereby incorporated by reference in its entirety for all purposes.

STATEMENT REGARDING FEDERALLY SPONSORED RESEARCH OR DEVELOPMENT

The invention was made with Government support, and the Government has certain rights in the invention by the terms of Contract No. FA8650-07-C-1100 awarded by the Department of the Air Force.

BACKGROUND

Antenna systems may be assembled using a phased array, which is a group of antennas in which the relative phases of the respective signals feeding the antennas are varied in such a way that the effective radiation pattern of the array is reinforced in a desired direction and suppressed in undesired directions. A phased array of an antenna system may include building blocks sometimes referred to as tiles. These tiles, however, are generally not considered to be a viable business option, due to the prohibitive manufacturing expenses and the excessive mass of tile designs.

SUMMARY

In one aspect of the disclosure, integrating resonating ground cavities of patch radiating elements into a support structure of an antenna tile may result in significant improvements in antenna performance, assembly cost and time, and mass of the antenna tile.

In one aspect of the disclosure, an antenna tile may comprise one or more antenna patch elements, a circuit board, and a support structure. The one or more antenna patch elements may radiate radio frequency (RF) signals, and each of the one or more antenna patch elements may comprise a conductive layer. The circuit board may be disposed between the one or more antenna patch elements and the support structure. The support structure may comprise one or more ground cavities. The one or more ground cavities may be integrated into the support structure and may be electrically conductive. The one or more ground cavities may resonate standing waves, and the one or more ground cavities may be disposed below the respective one or more antenna patch elements.

In another aspect of the disclosure, a method of manufacturing an antenna tile may comprise one or more of the following: providing one or more antenna patch elements; providing a circuit board; providing a support structure comprising one or more ground cavities; attaching the circuit board to the support structure; and attaching the one or more antenna patch elements to the circuit board. Each of the one or more antenna patch elements may comprise a conductive layer. The one or more ground cavities may be integrated into the support structure and may be electrically conductive. The one or more ground cavities may resonate standing waves. The one or more ground cavities may be disposed below the respective one or more antenna patch elements.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

FIG. 1A is an exploded view illustrating an example of an antenna tile, as seen from the top side of the antenna tile.

FIG. 1B is a simplified view illustrating an example of an antenna tile, as seen from the top side of the antenna tile.

FIG. 1C is an exploded view illustrating an example of an antenna tile, as seen from the bottom side of the antenna tile.

DETAILED DESCRIPTION

Figure 2:
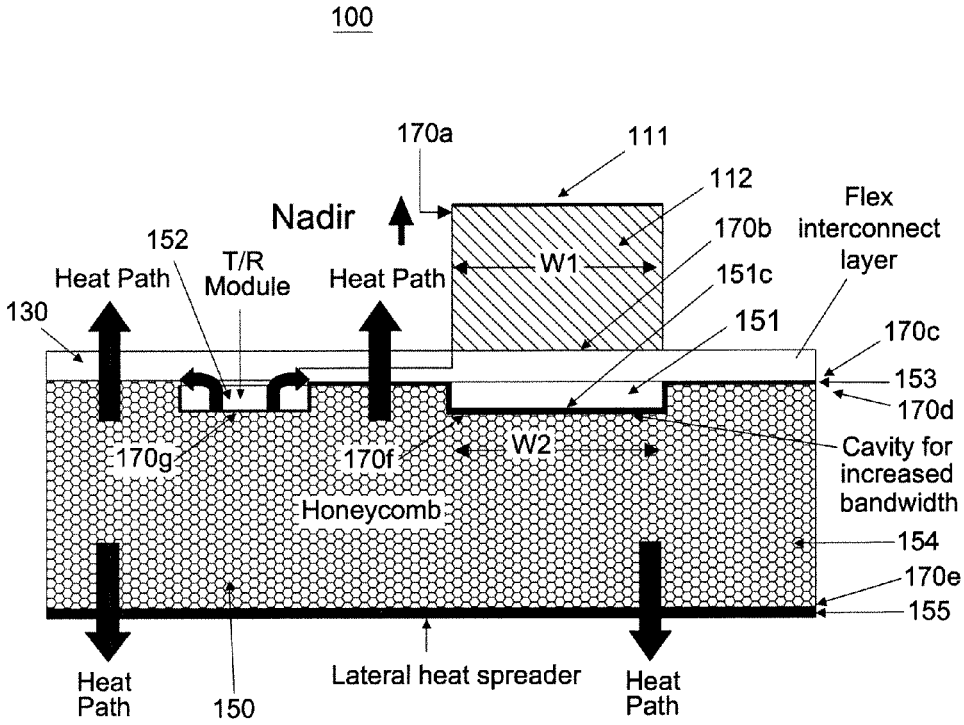
FIG. 2 is a simplified sectional view illustrating an example of an antenna tile, as seen from a side of the antenna tile.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like or similar components are labeled with identical element numbers for ease of understanding.

FIG. 1A is an exploded view illustrating an example of an antenna tile seen from the top side of the antenna tile. FIG. 1B illustrates a simplified top-down view of the antenna tile shown in FIG. 1A. FIG. 1C is an exploded view of the antenna tile shown in FIG. 1A, as seen from the bottom side of the antenna tile. An antenna tile 100 (sometimes referred to as a tile) may include one or more antenna patch elements 110 (sometimes referred to as patch elements or radiating elements). In this example, six antenna patch elements are shown. The antenna tile 110 may also include a circuit board 130 and a support structure 150.

In one example, each of the antenna patch elements 110 may have a top surface and a bottom surface and may include (i) a conductive layer 111 (e.g., a metal such as copper) having a top surface 111*a* and a bottom surface 111*b* and optionally (ii) a dielectric layer 112 (e.g., a foam dielectric) having a top surface 112*a* and a bottom surface 112*b*. Antenna patch elements 110 may be used to radiate signals such as radio frequency (RF) signals (e.g., L-band RF signals). A dielectric layer 112 may be used to physically support its respective conductive layer 111. A circuit board 130 may have a top surface 130*a* and a bottom surface 130*b* and may include one or more circuit modules 131. A support structure 150 may have a top surface 150*a* and a bottom surface 150*b* and may include one or more ground cavities 151 and optionally one or more module cavities 152. In this embodiment, a ground cavity 151 is electrically conductive and includes a metal layer (e.g., copper). In one configuration, each of the components 110, 111, 112, 130, and 150 is generally planar.

FIG. 2 is a simplified sectional view illustrating an example of an antenna tile seen from a side of the antenna tile. In one example, the size W1 of a dielectric layer 112 may be larger than the size W2 of a ground cavity 151. In another example, W1 may be the same as or smaller than W2.

A support structure 150 may include an inner structure 154. In one advantageous configuration, an inner structure 154 may include a perforated honeycomb structure and may be conductive (e.g., comprised of a metal such as aluminum). A support structure 150 may also include a top face sheet 153 and/or a bottom face sheet 155. Each of the face sheets may be, for example, a conductive layer (e.g., a metal such as aluminum). In this example, each of the inner structure and the face sheets is electrically and thermally conductive. An inner structure may be, for example, about 0.2 to 0.4 inches thick. Each face sheet may be, for example, about 0.01 to 0.02 inches thick.

Figure 3:
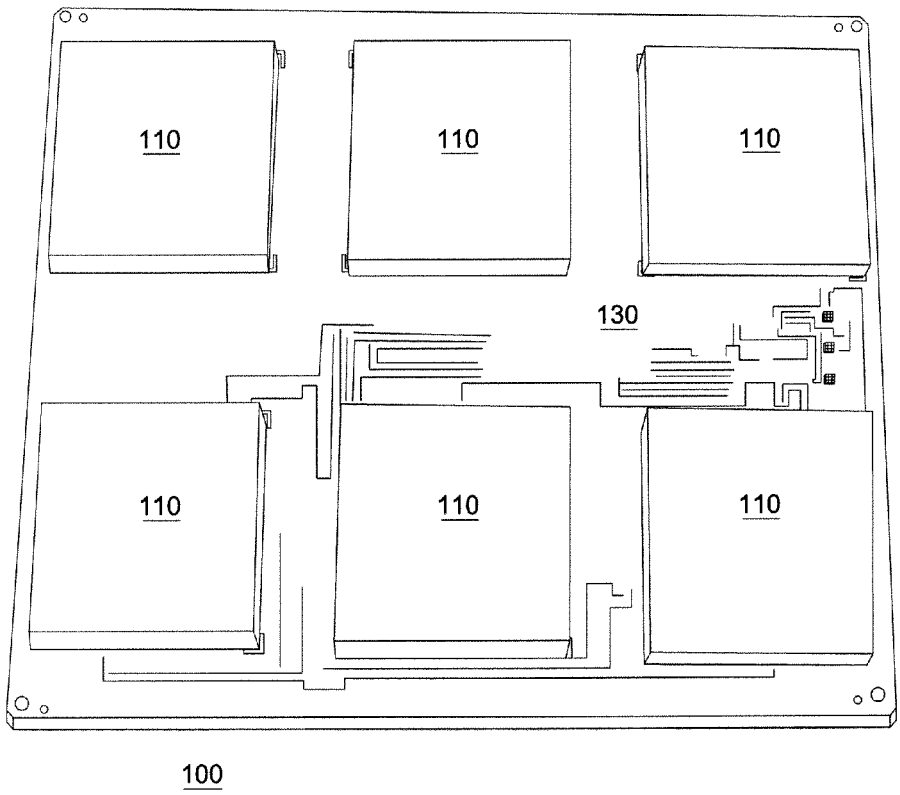
FIG. 3 is a view illustrating an example of an antenna tile, as seen from the top side of the antenna tile.

FIG. 3 is a view illustrating an example of an antenna tile seen from the top side of the antenna tile. In this example, six antenna patch elements 110 are disposed on top of a circuit board 130. In one configuration, the top surface of the circuit board 130 is generally planar, and there is substantially no protrusion extending vertically in the areas not covered by the patch elements 110. While the top surface of the circuit board 130 may have some height variations due to irregularity caused by, for example, underlying circuit traces or solder traces, the height variation may be much smaller than the height of the antenna patch elements (e.g., 3 to 30 times less or any number in-between).

Figure 4:
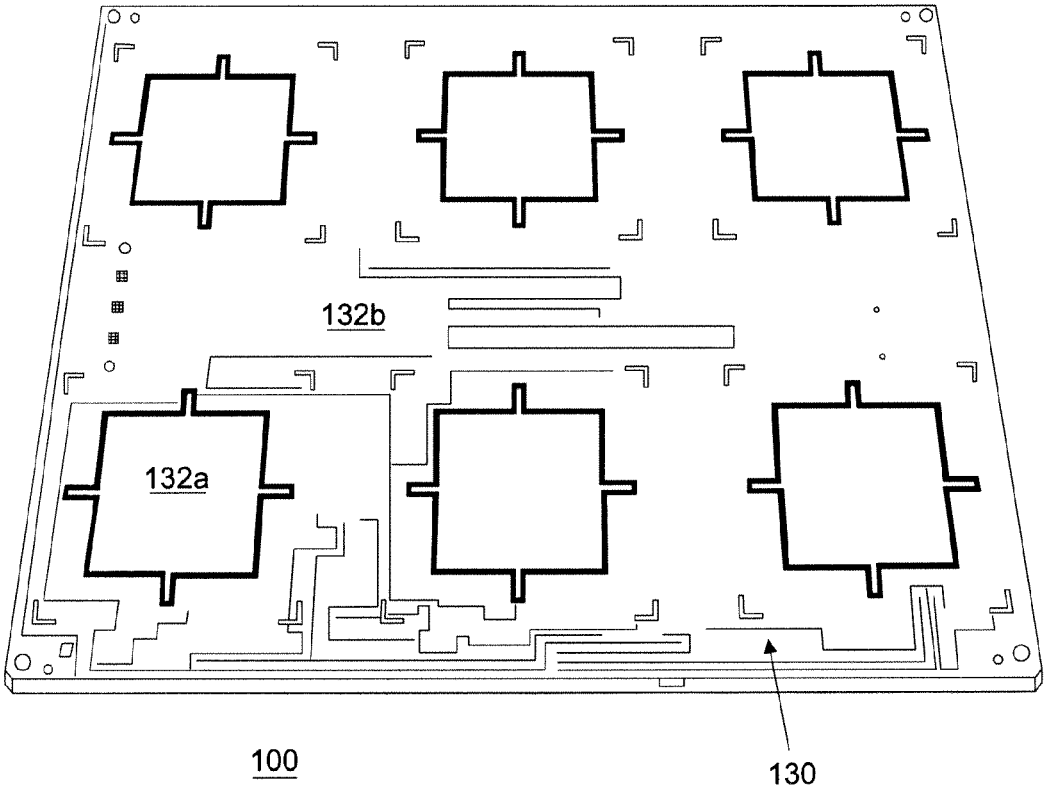
FIG. 4 is a view illustrating an example of an antenna tile without patch elements, as seen from the top side of the antenna tile.

FIG. 4 shows a circuit board 130 prior to attaching patch elements 110, as seen from the top side of the circuit board. A circuit board 130 may include one or more top islands 132*a* and a top face sheet 132*b* on the top surface. In this example, six top islands 132*a* are shown, each corresponding to its respective patch element 110. A top island 132*a* may be a conductive layer. In another example, a top island 132*a* may be a non-conductive layer (e.g., dielectric). A top face sheet 132*b* may be, for example, a conductive layer, which may be a ground layer. In one example, no circuit modules are attached to the top side of the circuit board 130.

Figure 5:
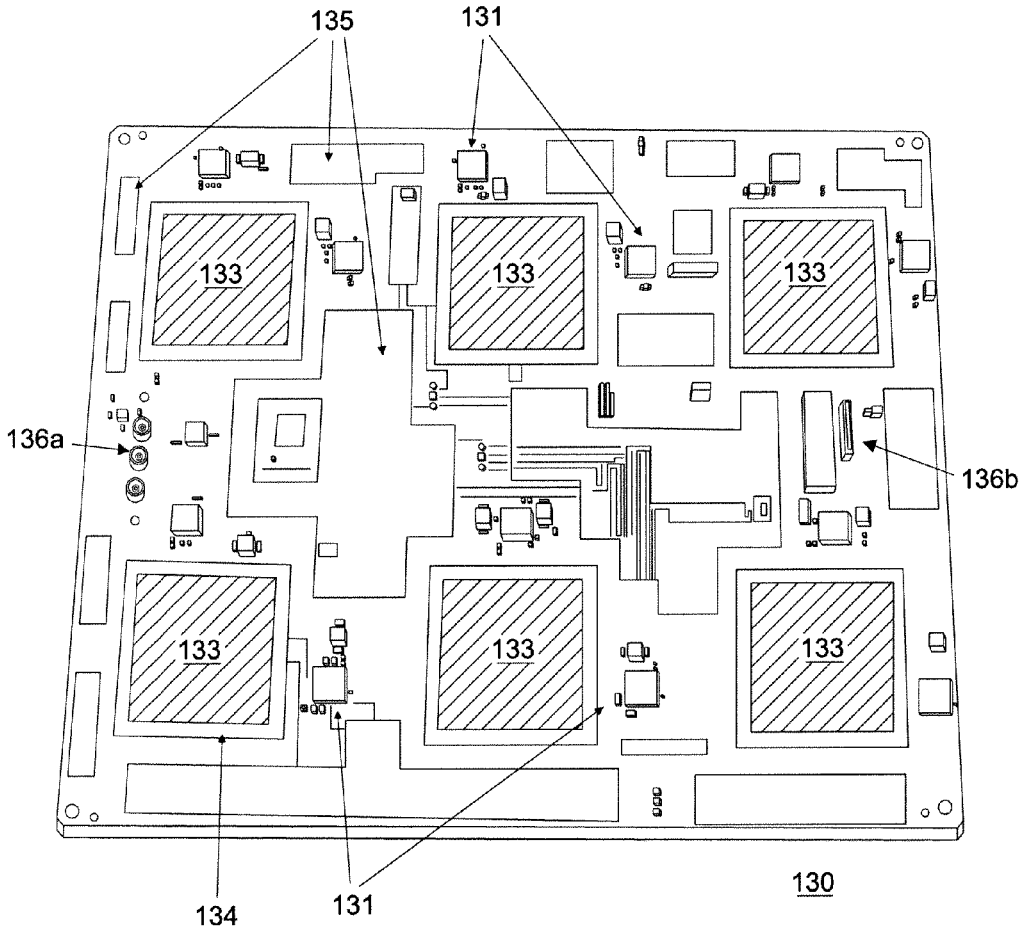
FIG. 5 is a view illustrating an example of a circuit board of an antenna tile, as seen from the bottom side of the circuit board.

FIG. 5 is a view illustrating an example of a circuit board 130 seen from the bottom side of the circuit board. A circuit board 130 may include, on its bottom surface, one or more bottom islands 133, one or more bottom rims 134, one or more circuit modules 131, and one or more conductive regions 135. In this example, six bottom islands 133 are shown, each for mating with its corresponding patch element 110 and corresponding ground cavity 151. A bottom island 133 may be a non-conductive layer (e.g., dielectric). In this example, six bottom rims 134 are shown, each for its corresponding ground cavity 151. A bottom rim 134 may be conductive (e.g., comprised of a metal such as copper). A conductive region 135 may be used for ground and may be made of a metal such copper. A circuit board 130 may also include one or more connectors such as coaxial connectors 136*a* (e.g., for radio frequency (RF) signals) and control signal connectors 136*b* (e.g., digital control/data signals). These connectors may carry signals to and from the circuit modules.

A circuit module 131 may include one or more of the following: a transmitter (T), a receiver (R), and/or a transceiver. These are sometimes referred to as a T/R module (as shown in FIG. 2). A circuit module 131 may also include one or more of the following: a driver module, a switch module, capacitors, resistors, and/or temperature sensors. A circuit module 131 may include analog circuits, digital circuits and/or a combination of both. In one advantageous configuration, a circuit module may be a low mass, low cost quad flat-pack no-lead (QFN) plastic encapsulated module (PEM) radio frequency (RF) module package.

Figure 6:
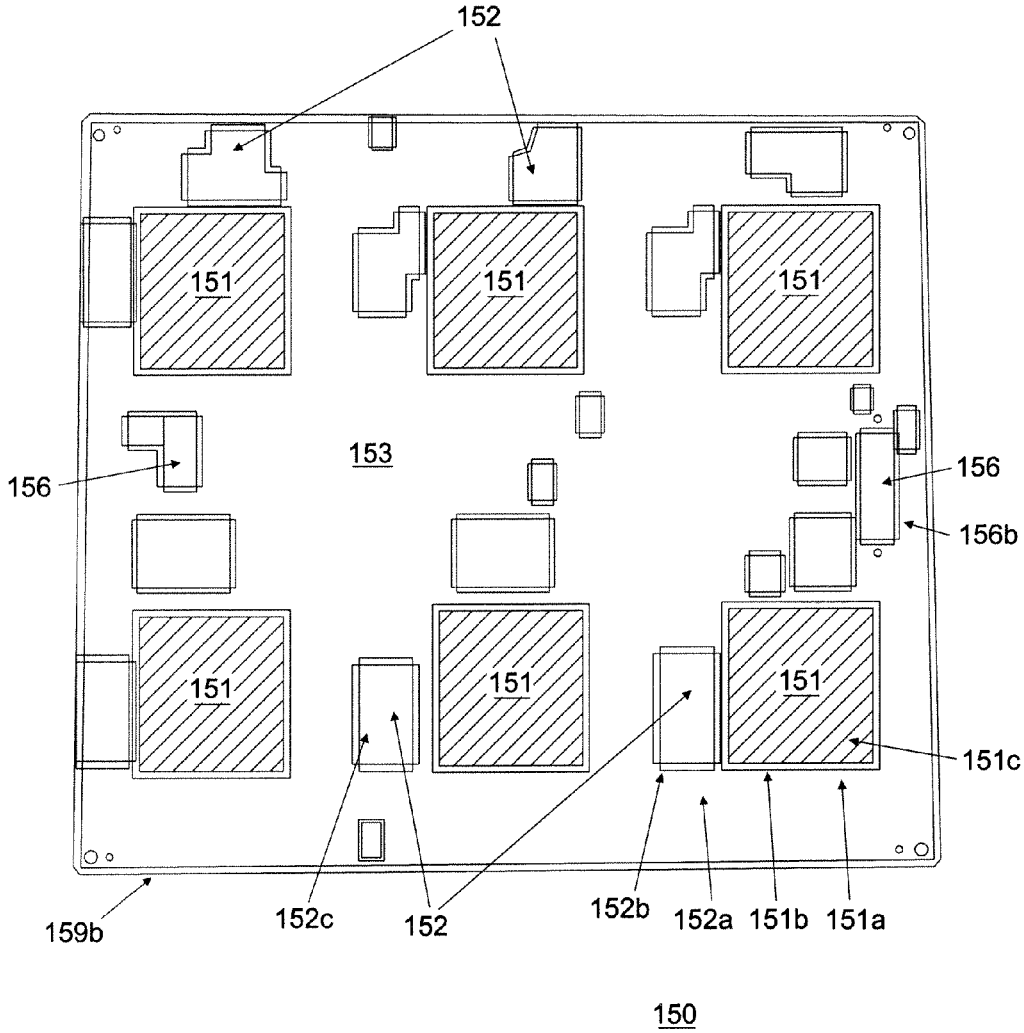
FIG. 6 is a view illustrating an example of a support structure of an antenna tile, as seen from the top side of the support structure.

FIG. 6 is a view illustrating an example of a support structure seen from the top side of the support structure. A support structure 150 may include, on its top surface, one or more ground cavities 151. A support structure 150 may also include one or more module cavities 152, a top face sheet 153 and/or a bottom face sheet (e.g., 155 in FIG. 2). In this example, six ground cavities 151 are shown, each for mating with its corresponding patch element 110. Each of the module cavities 152 may also mate with its respective circuit module 131.

A support structure 150 may also include one or more access openings 156 for connectors (e.g., 136*a*, 136*b* in FIG. 5). An access opening 156 may provide a hole through the entire thickness of the support structure, and its rim 156*b* (and its side wall) may be coated with a dielectric layer (e.g., Kapton®). A support structure 150 may also have a strip of a dielectric layer along the top edge 159*b* of the support structure.

In the embodiment shown in FIG. 6, a support structure 150 may include one or more first physical pockets 151*a* formed on the top surface (as opposed to the bottom surface of the support structure 150). Each of the ground cavities 151 may be comprised of a conducive layer 151*c* (e.g., a metal sheet such as a copper foil) that is integrally attached to a respective one of the first physical pockets 151*a* and to a rim 151*b* of the respective one of the first physical pockets 151*a*. An adhesive 170*f* (see FIG. 2) such as a conductive sheet adhesive with a release liner may be used to attach the conductive layer 151*c* to the pocket and its rim. When assembled, the conductive layer on the rim 151*b* mates with its corresponding bottom rim 134 (see FIG. 5) of the circuit board 130 for electrical connection and mechanical attachment. The conductive sheet of a ground cavity 151 covers the surface of its respective physical pocket 151*a* and its rim 151*b*. In one example, adhesive-backed copper-foil lined ground cavities significantly simplify the tile assembly. A ground cavity may be, for example, 2.0 to 2.5 inches (in a first horizontal direction), 2.0 to 2.5 inches (in a second horizontal direction), and 0.7 to 0.15 inches (in a vertical direction). A conductive layer 151*c* may be, for example, 0.001 to 0.003 inches thick.

In one aspect, an antenna tile 100 may have one common radio frequency (RF) ground. The conductive layers of ground cavities 151, ground traces of circuit modules 131, ground traces on/in a circuit board 130 (e.g., 132*b* in FIG. 4), and ground traces on/in a support structure 150 (e.g., 153, 154 and 155 in FIG. 2) may be all connected together to the common ground.

In this embodiment, a support structure 150 may also include one or more second physical pockets 152*a* formed on the top surface. Each of the module cavities 152 may be comprised of a non-conductive sheet 152*c* (e.g., a dielectric such as Kapton®) that is integrally attached to a respective one of the second physical pockets 152*a* and to a rim 152*b* of the respective one of the second physical pockets 152*a*. A non-conductive sheet 152*c* may prevent machining debris. An adhesive 170*g* (see FIG. 2) such as a non-conductive sheet adhesive with a release liner may be used to attach the non-conductive sheet to the pocket and its rim. When assembled, a portion of the non-conductive sheet on the rim 152*b* is attached to the bottom surface of the circuit board 130. A non-conductive sheet 152*c* and an adhesive 170*g* together may be referred to as a non-conductive tape.

In the configuration shown in FIG. 6, the top face sheet 153 does not cover up the conductive layers 151*c*, the dielectric layers 152*c* or the openings 156. In this example, the top face sheet 153 does not cover up any of the layers on the rims or edges (e.g., the dielectric layer on the rim 156*b*, the dielectric layer on the rim 152*b*, the dielectric layer on the top edge 159*b* of the support structure 150, or the conductive layer on the rim 151*b*).

Figure 7:
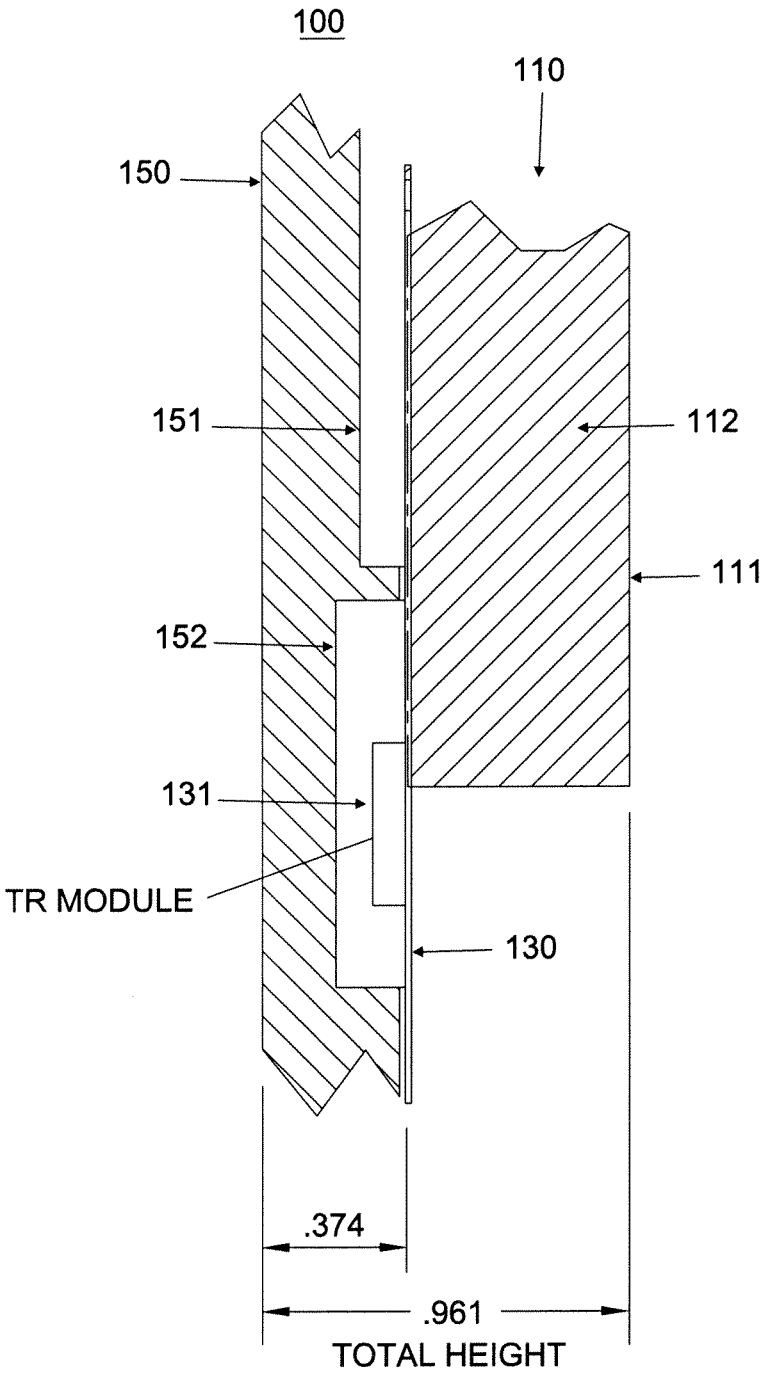
FIG. 7 is a simplified sectional view illustrating an example of an antenna tile, as seen from a side of the antenna tile.

FIG. 7 is a simplified sectional view illustrating an example of an antenna tile seen from a side of the antenna tile. In one example, a support structure 150 may be about 0.3 to 0.4 inches thick, and an antenna tile 100 may be about 0.9 to 1 inch thick. These are simply examples, and the subject technology is not limited to these examples.

Figure 8:
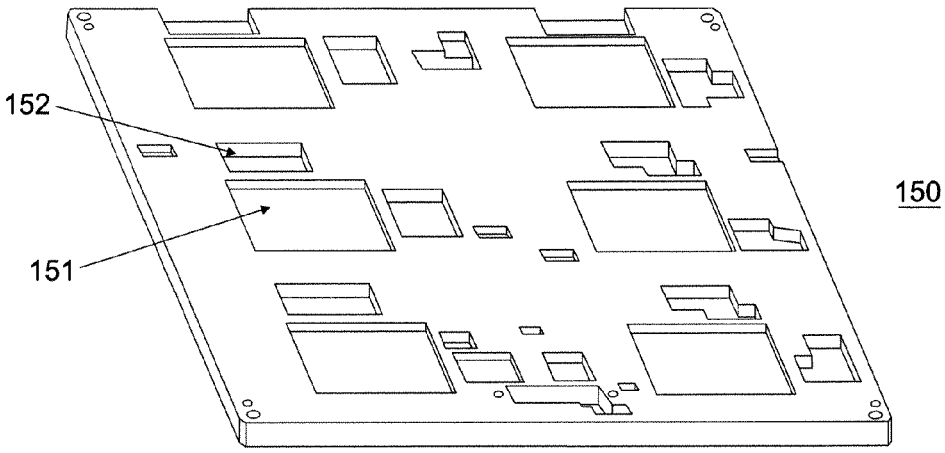
FIG. 8 is a simplified view illustrating an example of a support structure of an antenna tile, as seen from the top side of the support structure.
Figure 9:
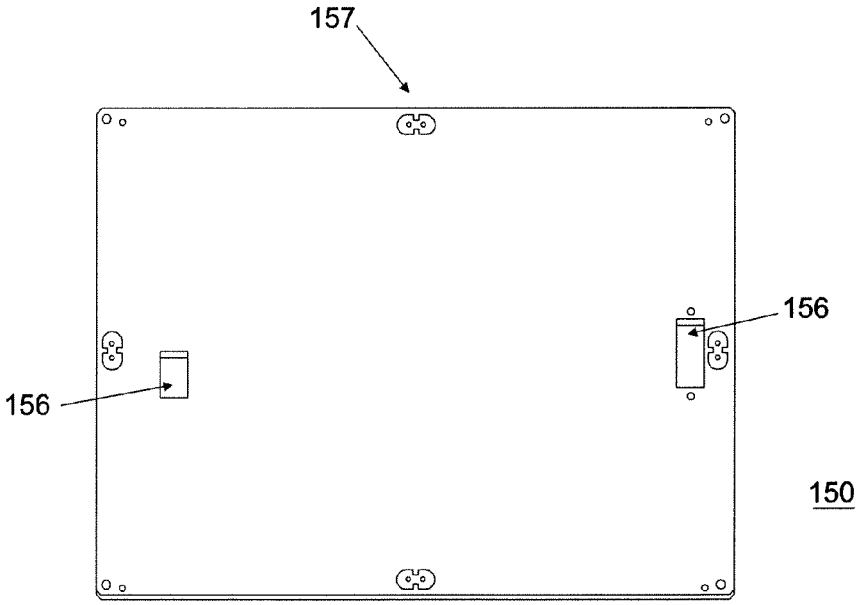
FIG. 9 is a view illustrating an example of a support structure of an antenna tile, as seen from the bottom side of the support structure.

FIG. 8 is a simplified view illustrating an example of a support structure seen from the top side of the support structure. FIG. 9 is a view illustrating an example of a support structure seen from the bottom side of the support structure. A support structure 150 may include, on its bottom surface, inserts 157. In this example, four inserts 157 are centered in the support structure's edges to provide stable mounting of the support structure to its respective frame (e.g., 160 in FIG. 12) while allowing an antenna tile (e.g., 100) to be thermally decoupled from the frame.

Figure 10:
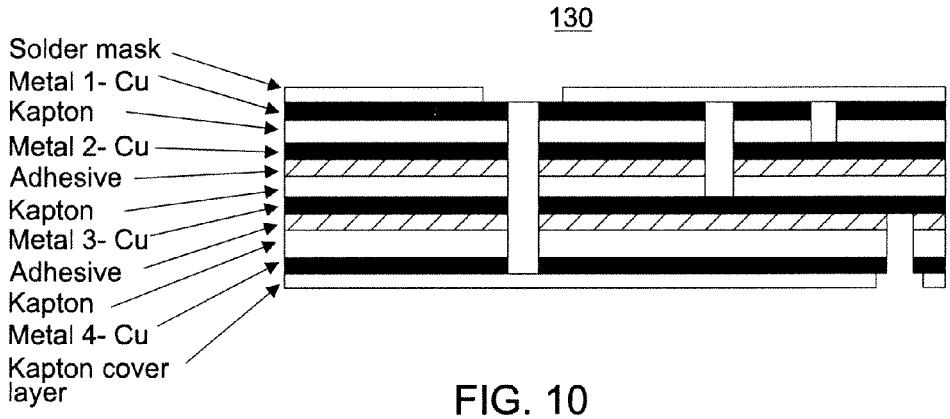
FIG. 10 is a view illustrating an example of a circuit board for an antenna tile, as seen from a side of the circuit board.

FIG. 10 is a view illustrating an example of a circuit board seen from a side of the circuit board. A circuit board 130 in FIG. 10 may be a multi-layer flexible circuit board. A flexible circuit board 130 may include a solder mask layer, multiple metal layers (e.g., copper), multiple dielectric layers (e.g., Kapton®), one or more adhesive layers, and a cover layer (e.g., Kapton®). In one aspect, it is advantageous to use a flexible circuit board. The dielectric constant of a dielectric layer in FIG. 10 may be, for example, 3.4, and the loss tangent may be, for example, 0.003.

Figure 11:
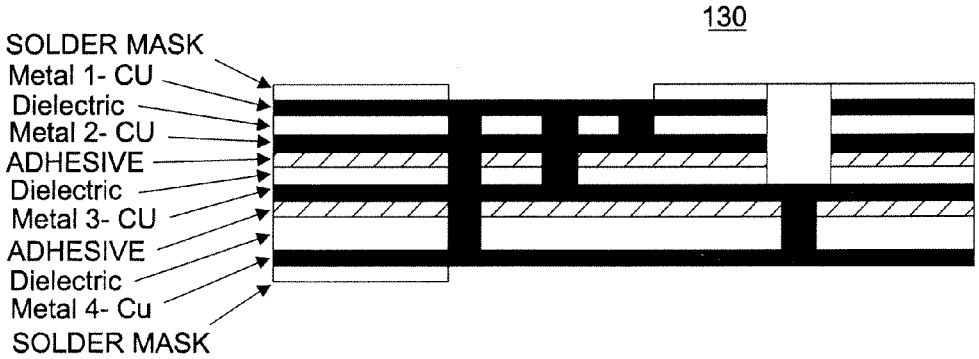
FIG. 11 is a view illustrating an example of a circuit board for an antenna tile, as seen from a side of the circuit board.

FIG. 11 is a view illustrating an example of another circuit board seen from a side of the circuit board. A circuit board 130 in FIG. 11 may be a multi-layer rigid circuit board. A rigid circuit board 130 may include one or more solder mask layers, multiple metal layers (e.g., copper), multiple dielectric layers, and one or more adhesive layers. A dielectric layer in a rigid circuit board may be made rigid by incorporating (or being reinforced with) particles such as fabric or glass weaves. The dielectric constant of a dielectric layer in FIG. 11 may be, for example, 2.94, and the loss tangent may be, for example, 0.0015. While FIGS. 10 and 11 illustrate multi-layer circuit boards, the subject technology is not limited to multi-layer boards.

Referring to FIGS. 1A through 11, in one configuration, one or more antenna patch elements 110 are disposed above, and vertically aligned with, respective one or more top islands 132*a* (FIG. 4), respective one or more bottom islands 133 (FIG. 5), and respective one or more ground cavities 151. The one or more antenna patch elements may be capacitively coupled with respective one or more ground cavities. In one configuration, one or more circuit modules 131 are disposed above, and vertically aligned with, respective one or more module cavities 152. In one configuration, one or more bottom rims 134 on a circuit board 130 are disposed above, attached to, and vertically aligned with, respective one or more rims 151*b* on a support structure 150.

Figure 12:
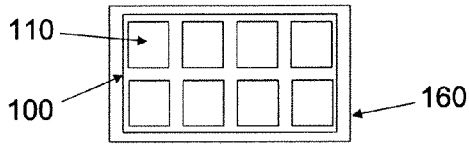
FIG. 12 is a view illustrating an example of a frame on which an antenna tile is mounted, as seen from the top side of the frame.

FIG. 12 is a view illustrating an example of a frame on which an antenna tile is mounted, as seen from the top side of the frame. An antenna tile 100 with patch elements 110 may be mounted on a frame 160. A frame may be comprised of, for example, graphite composite material.

Figure 13:
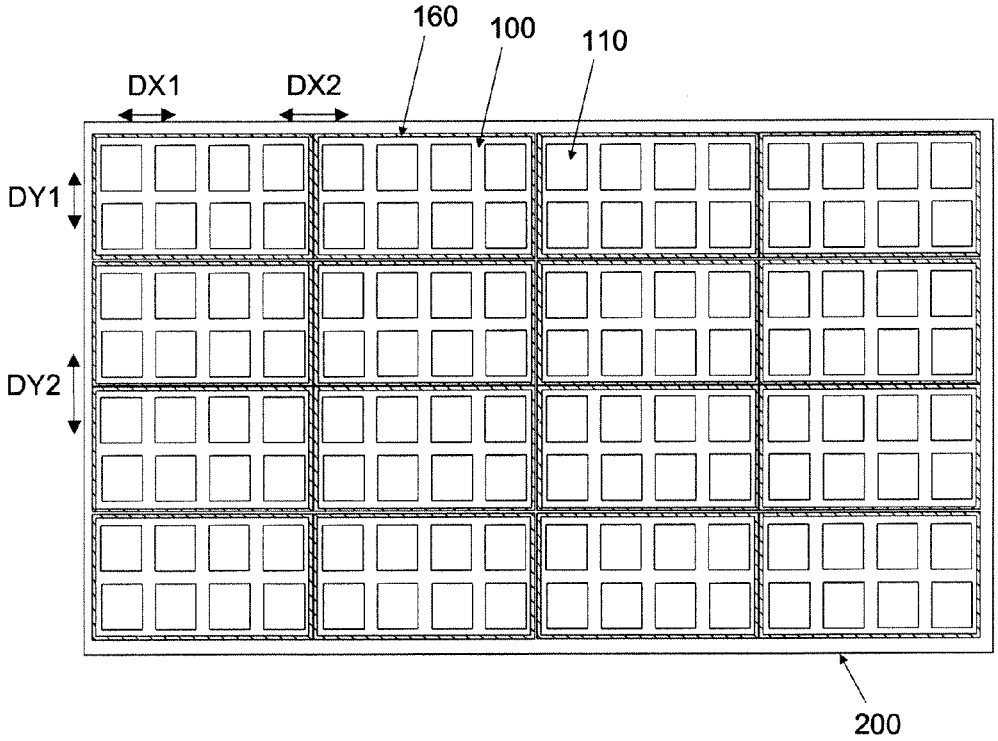
FIG. 13 is a view illustrating an example of a panel on which framed antenna tiles are mounted, as seen from the top side of the panel.

FIG. 13 is a view illustrating an example of a panel on which framed antenna tiles are mounted, as seen from the top side of the panel. An array of frames 160, each with its antenna tile 100, may be mounted on a panel 200. In one example, a horizontal pitch DX1 among patch elements 110 on a tile 100 may be made constant. A vertical pitch DY1 among patch elements 110 on a tile 100 may be also made constant. A horizontal pitch DX2 among patch elements 110 across different tiles 100 may be also made constant. A vertical pitch DY2 among patch elements 110 across different tiles 100 may be also made constant. In one example, DX1, DY1, DX2 and DY2 may be equal. In another example, one or more of DX1, DY1, DX2 and DY2 may be made different. When a patch element pattern is centered on a tile, this allows 180 degree tile rotation in a panel.

Various additional or alternative configurations of the subject technology are described below. In one configuration, each of one or more antenna patch elements may include a conductive layer (e.g., 111 in FIG. 1A) but without a dielectric layer. In this case, the conductive layer of an antenna patch element may be attached directly (without a dielectric layer) to a circuit board (e.g., 130). Furthermore, in one aspect, a conductive layer of an antenna patch element may be made into (and thus integrated into) a circuit board as one of the top metal layers during the manufacturing process of the circuit board. While square-shaped patch elements are shown in FIG. 3, a patch element may have other shapes.

In one configuration, a support structure (e.g., 150) may be a solid piece rather than having a honeycomb structure. In another configuration, a support structure does not have a top face sheet and/or a bottom face sheet. In yet another configuration, a support structure and any of its components (e.g., any face sheet or inner structure) may be non-conductive (e.g., electrically and/or thermally non-conductive).

Figure 14:
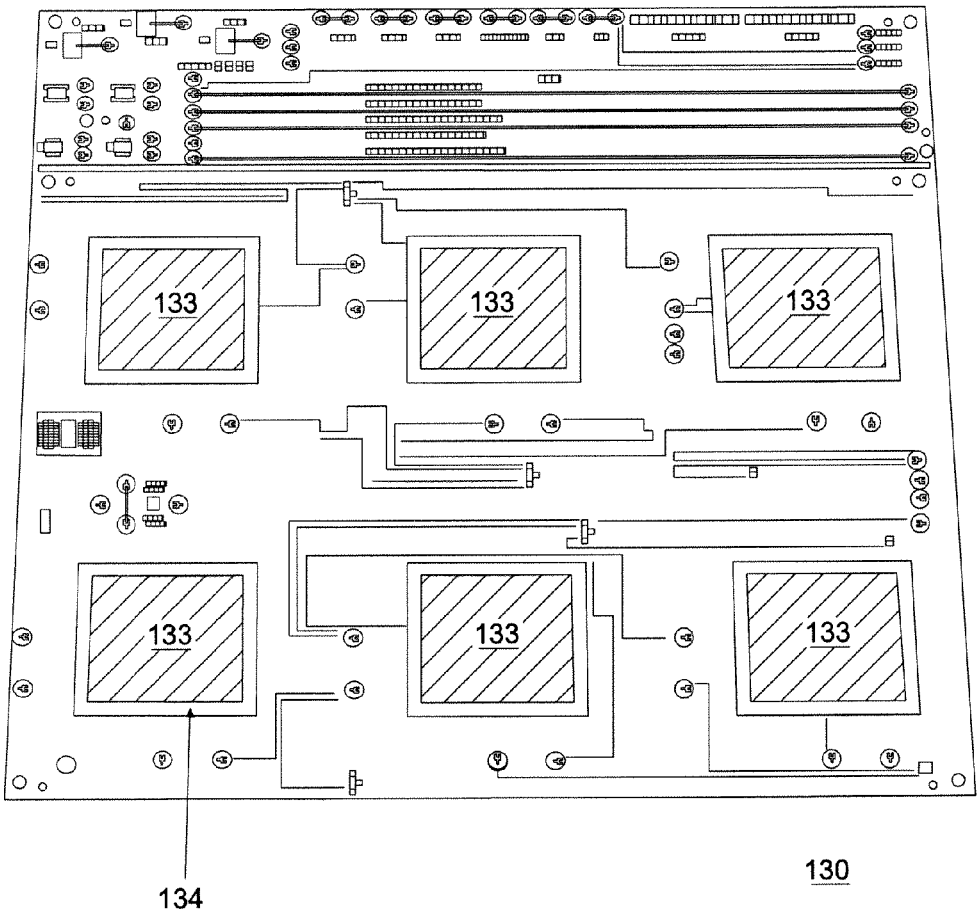
FIG. 14 is a view illustrating an example of a circuit board for an antenna tile, as seen from the bottom side of the circuit board.
Figure 15:
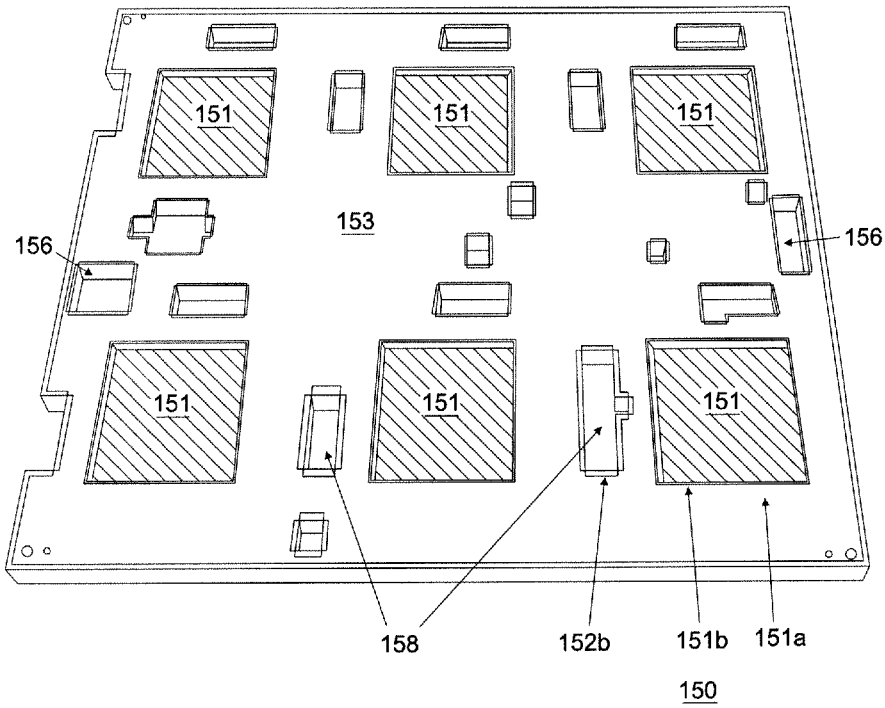
FIG. 15 is a view illustrating an example of a support structure for an antenna tile, as seen from the top side of the support structure.

FIGS. 14 and 15 provide other alternative configurations of the subject technology. FIG. 14 is a view illustrating an example of a circuit board seen from the bottom side of the circuit board. A circuit board 130 in FIG. 14 may include dielectric islands 133 and conductive rims 134 that surround the dielectric islands 133. In one example, the circuit board in FIG. 14 may include circuit modules and connectors.

FIG. 15 is a view illustrating an example of a support structure seen from the top side of the support structure. A support structure 150 in FIG. 15 may include ground cavities 151, cavities or openings 158, a face sheet 153, and connector openings 156. In comparison to the support structure shown in FIG. 6, the support structure in FIG. 15 does not include dielectric cavities. The cavities 158 may be provided to keep clear of the components that may be on the bottom side of a circuit board. In one example, a support structure 150 in FIG. 15 may be used for a passive tile.

Figure 16A:
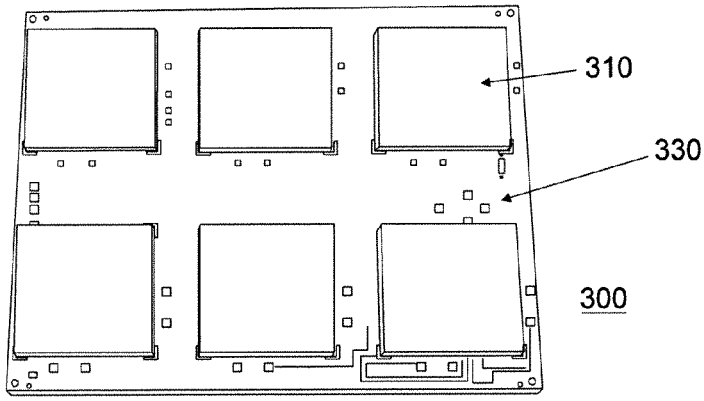
FIG. 16A is a view illustrating an example of an antenna tile seen from the top side of the antenna tile.
Figure 16B:
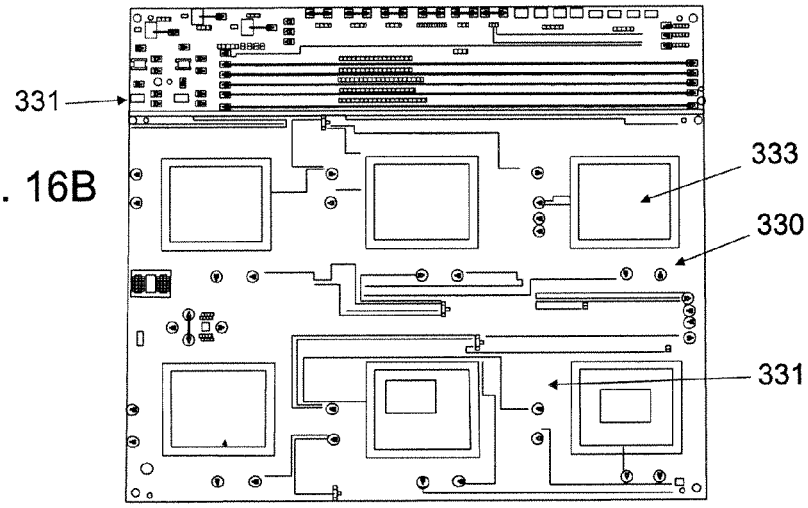
FIG. 16B is a view illustrating an example of a circuit board for an antenna tile, as seen from the bottom side of the circuit board.
Figure 16C:
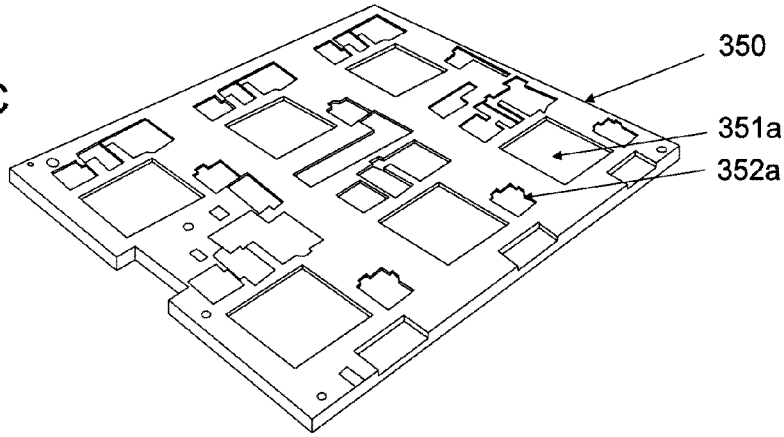
FIG. 16C is a view illustrating an example of a support structure for an antenna tile, as seen from the top side of the support structure.

FIGS. 16A, 16B and 16C illustrate an antenna tile constructed according to another approach. FIG. 16A is a view illustrating an example of an antenna tile seen from the top side of the antenna tile; FIG. 16B is a view illustrating an example of a circuit board seen from the bottom side of the circuit board; and FIG. 16C is a view illustrating an example of a support structure seen from the top side of the support structure. In FIGS. 16A-16C, an antenna tile 300 may include patch elements 310, a circuit board 330 and a support structure 350. The patch elements 310 may be placed on the top surface of a circuit board 330, and the bottom surface of the circuit board 330 may be attached to the top surface of the support structure 350. The antenna tile 300 may also include five-sided conductive ground boxes 333 (see FIG. 16B) soldered onto the bottom surface of the circuit board 330. The process of attaching the ground boxes to the circuit board is labor intensive and costly requiring many parts. During assembly, some of the difficulties associated with soldering the five-sided ground boxes to the circuit board include the following: The ground box cavities do not remain flat during reflow and need to be weighted down. The solder joints on the interface areas of the ground boxes and the circuit board need to be touched up by hand. Cleaning solutions fill the ground box cavities, and significant bake-out time is required.

The support structure 350 may be a double-layer custom graphite composite structure that has first indented areas 351*a* and second indented areas 352*a*. The first indented areas 351*a* may be provided to keep clear of the ground boxes 333, and the second indented areas 352*a* may be provided to keep clear of the components 331 (e.g., circuit modules, electrical connectors) on the bottom surface of the circuit board 330. A circuit module included in an antenna tile 300 may be a low temperature co-fired ceramic (LTCC) ball grid array (BGA) package. The first and second indented areas 351*a* are not coated with any conductive material. When assembled, the ground boxes 333 are not in contact with, and are not attached to, the support structure 350. A gap exists between the ground boxes 333 and the first indented areas 351*a*, and there is no adhesive between the ground boxes 333 and the first indented areas 351*a*.

Figure 17:
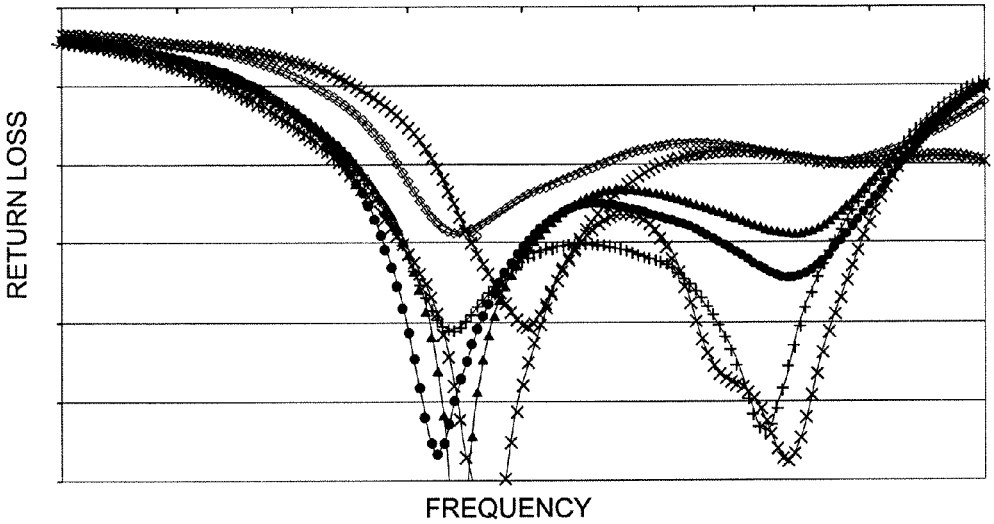
FIG. 17 illustrates an example of return loss plots for an antenna tile constructed using a technique described with reference to FIGS. 16A-16C.

FIG. 17 illustrates an example of return loss plots for an antenna tile constructed with ground boxes attached to a circuit board using a technique described with reference to FIGS. 16A-16C. Each line in FIG. 17 is for a patch element. The return loss plots for six patch elements indicate inconsistent results with poor tracking.

Figure 18:
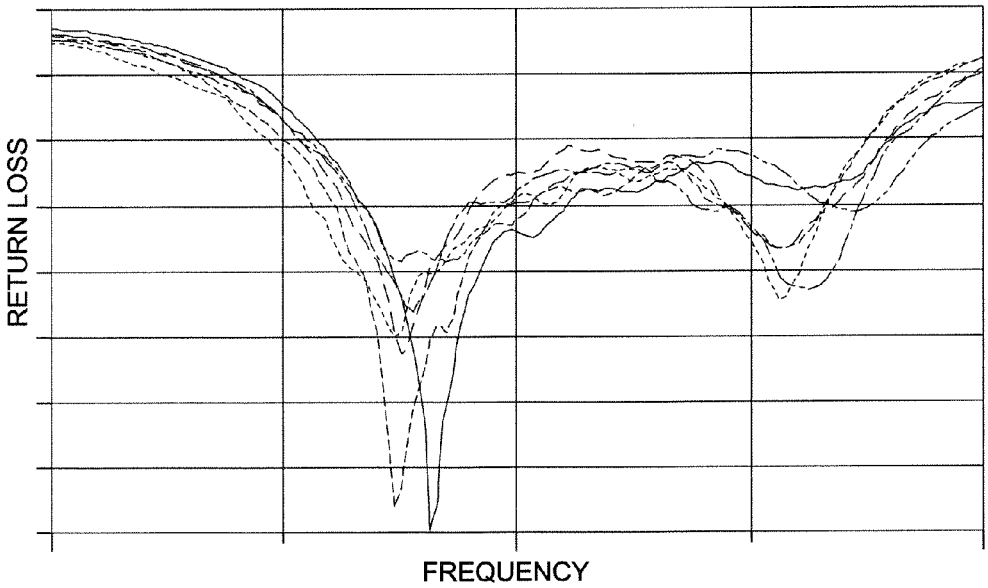
FIG. 18 illustrates an example of return loss plots of an antenna tile constructed using a technique described with reference to FIGS. 3-6.

FIG. 18 illustrates an example of return loss plots of an antenna tile constructed using a technique described with reference to, for example, FIGS. 1A through 6. Each line in FIG. 18 is for a patch element. The return loss plots for six patch elements with resonant ground cavities integrated into a support structure yield more consistent results and provide better performance than that shown in FIG. 17.

Now referring back to FIGS. 1A through 13, an antenna tile manufacturing process is described. In one example, antenna patch elements 110, a circuit board 130, and a support structure 150 may be fabricated separately and then assembled together to form an antenna tile. The components 110, 130 and 150 may be fabricated concurrently or sequentially.

To fabricate antenna patch elements 110, in one example, a large conductive sheet may be attached to a large dielectric sheet using an adhesive (e.g., a sheet adhesive), and the assembled unit may be cut to produce a plurality of small antenna patch elements 110, each with a conductive layer 111 and a dielectric layer 112. Alternatively, each antenna patch element 110 may be assembled individually by attaching a piece of a conductive layer to a piece of a dielectric layer using adhesive.

A circuit board 130 may be fabricated, for example, by assembling one or more conductive layers (e.g., metal traces, contacts, vias, islands, sheets) for carrying analog/digital control and data signals, power and/or ground, one or more dielectric layers (e.g., dielectric sheets, islands), and optionally one or more adhesive layers. One or more circuit modules may be attached to the circuit board 130. One or more connectors for electrical signals (e.g., digital and/or analog signals, power, and ground) may be attached to the circuit board. In one configuration, one of the top metal layers on a circuit board 130 may be used as a conductive layer of one or more antenna patch elements when the patch elements do not include a dielectric layer.

A support structure 150 may be fabricated, for example, by providing a substrate (e.g., inner structure 154 in FIG. 2), forming one or more first pockets (e.g., 151*a*) on the substrate for respective one or more ground cavities, forming one or more second pockets (e.g., 152*a*) for respective one or more circuit modules, and/or forming one or more opening (e.g., 156) for connectors. One or more conductive sheets (e.g., 153 and 155) may be formed on the top and/or bottom surfaces of the support structure by, for example, using a sheet adhesive to attach the sheets to the support structure. In addition, one or more conductive sheets (e.g., copper foil) may be provided (e.g., attached using a sheet adhesive) in the one or more first pockets and on the respective one or more rims. One or more dielectric sheets (e.g., Kapton®) may be provided (e.g., attached using a sheet adhesive) in the one or more second pockets and on the respective one or more rims. One or more dielectric layers may be also formed on the one or more rims of the openings.

In assembly, one or more antenna patch elements 110, a circuit board 130, and a support structure 150 may be provided. Each of the components 110, 130 and 150 may be prepared and provided concurrently or at different times or in various orders. In one example, a circuit board 130 may be attached to a support structure 150, and then one or more antenna patch elements 110 may be attached to the circuit board 130. In another assembly process, this order may be reversed.

Each of the one or more antenna patch elements may include a conductive layer and optionally a dielectric layer. A support structure 150 may include one or more ground cavities 151 that are integrated into the support structure and electrically conductive. The one or more ground cavities may be resonating cavities and may resonate standing waves. The depth of a ground cavity may be a function of the operating frequency and bandwidth.

The one or more ground cavities 151 may be disposed vertically below the respective one or more antenna patch elements 110. The circuit board 130 may be disposed vertically above the support structure 150.

Various components may be attached to each other using adhesives. For example, referring to FIG. 2, one or more antenna patch elements 110 may be attached to a circuit board 130 using an adhesive layer 170*b*. A circuit board 130 may be attached to a support structure 150 using an adhesive layer 170*c*. Various components within components 110, 130 and 150 may also be attached to one another using adhesives. For example, a conductive layer 111 may be attached to a dielectric layer 112 using an adhesive layer 170*a*. A face sheet 153 may be attached to an inner structure 154 using an adhesive layer 170*d*. A face sheet 155 may be attached to an inner structure 154 using an adhesive layer 170*e*. An adhesive or an adhesive layer may be, for example, a sheet adhesive with a release liner (e.g., a peel-and-stick type of adhesive sheet). An adhesive may be conductive or non-conductive depending on the type of surfaces to be attached. When attaching conductive layers or surfaces, a conductive adhesive may be utilized. When attaching non-conductive layers or surfaces or when attaching one conductive layer to a non-conductive layer, a non-conductive adhesive may be utilized. For example, an adhesive layer 170*a*, 170*b* may be non-conductive. An adhesive layer 170*c* may be conductive or non-conductive. An adhesive layer 170*d*, 170*e* may be conductive when the components 153, 154 and 155 are conductive. An adhesive layer 170*f* between the conductive layer 151*c* and the surface of a pocket 151*a* in the support structure may be conductive. An adhesive layer 170*g* in a module cavity may be non-conductive. Conductive adhesives can provide electrical as well as thermal conduction.

After antenna tiles are assembled, they may be attached to a frame (e.g., 160 in FIG. 12), and a plurality of frames may be attached to a top flat surface of a panel (e.g., 200 in FIG. 13).

In one aspect of the disclosure, antenna tiles (e.g., one shown as tile 100 in FIG. 1) may be used as modular building blocks for phased array satellite payloads (e.g., active radar phased array space tiles). Antenna tiles are generally not considered to be a viable business option, due to the prohibitive manufacturing expenses and the excessive mass of tile designs. For instance, as shown and described with reference to FIGS. 16A-16C, tiles (e.g., 300) may utilize (i) expensive customized composite honeycomb structures (e.g., 350 in FIG. 16C) to meet the thermal, mass, structural, and coefficient of thermal expansion (CTE) requirements of space missions, (ii) heavy, costly, rigid multi-layer printed circuit boards (MLB) (e.g., 330 in FIG. 16B) to provide the radio frequency (RF) interconnect, and (iii) separate (i.e., not integrated) five-sided ground-resonating cavity boxes (e.g., 333 in FIG. 16B) for patch elements. These five-sided boxes add cost and are not conducive to the desired automated assembly process. In this regard, tile designs utilizing rigid printed wiring boards (PWBs) and heavy/costly support structures are expensive to produce.

In one aspect of the present disclosure, the tile design of the subject technology can significantly reduce the overall tile mass and cost while improving the tile thermal efficiency. For example, changing from custom composite support structure to stock aluminum honeycomb support structure can result in 90% reduction in support structure cost. Integrating the ground cavity into the support structure results in part count reduction and process simplification. Accordingly, the entire tile can be fully assembled using automated equipment.

In one aspect, the cost and mass of an antenna tile of the subject technology (e.g., an L-band tile) is significantly reduced by (i) changing the tile cross-section so that the main thermal path no longer relies on coupling the back side of circuit modules to an inner face sheet layer of the support structure; (ii) integrating the resonating antenna ground cavities into the support structure, thus eliminating an additional part and process step; (iii) changing from costly customized support structure to more affordable all-aluminum stock honeycomb support structure; and/or (iv) utilizing flexible polyimide printed circuits instead of rigid MLBs.

In one aspect of the disclosure, an antenna tile such as a tile 100 in FIG. 3 offers many design enhancements over a tile such as a tile 300 in FIG. 16A. For example, in one configuration, a tile 100 uses a low mass, low cost quad flat-pack no-lead (QFN) plastic encapsulated module (PEM) radio frequency (RF) module package for a circuit module rather than an expensive, heavy low temperature co-fired ceramic (LTCC) ball grid array (BGA) package.

In one configuration, a tile 100 uses a low cost stock aluminum honeycomb panel as a support structure (e.g., 150) rather than a double-layer custom graphite composite structure. In one configuration, a tile 100 includes lining honeycomb ground cavities with copper foil. This eliminates the need for separate five-sided copper ground boxes. When integrated ground cavities are used, a circuit board (e.g., 130) can be attached to a support structure (e.g., 150) as received. No soldering is needed to provide ground cavities. Ground cavities for antenna patch elements are formed, for example, by copper foils lining in the support structure when the circuit board is attached to the support structure.

In one configuration, a tile 100 uses a sheet adhesive with a release liner to attach a flexible circuit board (e.g., 130) to a honeycomb support structure (e.g., 150). This eliminates the need for a heavy screened-on-paste adhesive. In one configuration, a patch element pattern is centered on a tile, and this allows 180 degree tile rotation in a panel. In one configuration, the tile size is reduced to allow nesting of tiles into a frame.

In one configuration, ground cavities (e.g., 151 in FIG. 6) of the subject technology have no shape separate and apart from the structural shape provided by the physical pockets of a support structure 150. Thin conductive layers such as a copper foil have no shape by themselves. The structural shape of the ground cavities is formed when the conductive layers are integrated into the support structure by attachment to the physical pockets in the support structure. The five-sided ground boxes 333 in FIG. 16B, on the other hand, have a definitive structural shape independently of the support structure 350 and the circuit board 330. The structural shape of the five-sided ground boxes exists independently of any other structure.

In one aspect of the disclosure, integrating resonating ground cavities (e.g., 151) of patch radiating elements (e.g., 110) into a support structure (e.g., 150) results in significant improvements in (i) antenna performance, (ii) assembly cost and time, and (iii) mass of the antenna tile. In one example, a cost savings of $60 per tile and a mass savings of about 2.8 grams per tile can be realized. In one example, an antenna tile (e.g., 100) may weigh about 400 to 420 grams.

In one aspect, antenna tiles of the subject technology may be utilized in active phased array antenna systems for space, aerospace or terrestrial use.

It should be noted that various exemplary dimensions, numbers, materials, and structures are provided in this disclosure, but the subject technology is not limited to these examples.

Those of skill in the art would appreciate that various components and blocks may be arranged differently (e.g., arranged in a different order, or partitioned in a different way) all without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An antenna tile, comprising:

one or more antenna patch elements for radiating radio frequency (RF) signals, each of the one or more antenna patch elements comprising a conductive layer;

a circuit board disposed between the one or more antenna patch elements and a support structure; and the support structure comprising one or more ground cavities, the one or more ground cavities being integrated into the support structure and electrically conductive, the one or more ground cavities for resonating standing waves, the one or more ground cavities disposed below the respective one or more antenna patch elements, wherein the one or more antenna patch elements are capacitively coupled to the respective one or more ground cavities, wherein:

each of the one or more antenna patch elements is vertically aligned with a respective one of the one or more ground cavities, the circuit board comprises a first top surface and a first bottom surface, the first top surface facing toward the one or more antenna patch elements, the first bottom surface facing away from the one or more antenna patch elements, the circuit board comprises multiple conductive layers on dielectric layers, the dielectric layers comprising rigid reinforcement material, flexible material without reinforcement, or a combination of rigid reinforcement material and flexible material without reinforcement, the circuit board comprises one or more circuit modules mounted on the first bottom surface, the one or more circuit modules coupled to the respective one or more antenna patch elements, the support structure comprises a second top surface and a second bottom surface, the second top surface facing toward the one or more antenna patch elements, the second bottom surface facing away from the one or more antenna patch elements, the second top surface comprises one or more first physical pockets, the one or more ground cavities comprise one or more conductive sheets, each of the one or more conductive sheets integrally attached to a respective one of the one or more first physical pockets and attached to a rim of the respective one of the one or more first physical pockets, the second top surface comprises one or more second physical pockets, each of the one or more circuit modules is disposed above and within a respective one of the one or more second physical pockets, the one or more antenna patch elements are attached to the first top surface, and the first bottom surface is attached to the second top surface.

2. The antenna tile of claim 1, wherein each of the one or more antenna patch elements further comprises a dielectric layer attached to the respective conductive layer and disposed below the respective conductive layer, each of the dielectric layer and the respective conductive layer is planar.

3. The antenna tile of claim 1, wherein each of the one or more circuit modules comprises an RF signal path and a ground path, the RF signal path is coupled to a respective one of the one or more antenna patch elements, and the ground path is coupled to a respective one of the one or more ground cavities.

4. The antenna tile of claim 1, wherein the conductive layer of each of the one or more antenna patch elements is directly attached to a top surface of the circuit board or integrated as a conductive plane layer within the circuit board.

5. The antenna tile of claim 1, wherein the support structure comprises a top face sheet, a bottom face sheet, and a honeycomb structure between the top and bottom face sheets.

6. The antenna tile of claim 5, wherein each of the top face sheet, the bottom face sheet, and the honeycomb structure comprises aluminum.

7. The antenna tile of claim 1, wherein the conductive layer of each of the one or more antenna patch elements comprises copper, the support structure comprises aluminum, and the one or more ground cavities comprises copper.

8. The antenna tile of claim 1, wherein the circuit board comprises a first top surface and a first bottom surface, the first top surface facing toward the one or more antenna patch elements, the first bottom surface facing away from the one or more antenna patch elements, the support structure comprises a second top surface and a second bottom surface, the second top surface facing toward the one or more antenna patch elements, the second bottom surface facing away from the one or more antenna patch elements, the one or more antenna patch elements are attached to the first top surface, and the first bottom surface is attached to the second top surface.

9. The antenna tile of claim 1, further comprising a sheet adhesive between the one or more antenna patch elements and the circuit board.

10. The antenna tile of claim 1, wherein the support structure comprises one or more physical pockets, and wherein the one or more ground cavities comprise one or more conductive sheets, each of the one or more conductive sheets integrally attached to a respective one of the one or more first physical pockets and attached to a rim of the respective one of the one or more first physical pockets using one or more conductive sheet adhesives.

11. The antenna tile of claim 1, wherein an antenna panel comprises an array of antenna tiles, a tile of the array of antenna tiles is the antenna tile, the antenna panel has a constant pitch among antenna tiles, the one or more antenna patch elements comprise an array of antenna patch elements, and the array of antenna patch elements has a constant pitch among antenna patch elements.

12. An antenna tile, comprising:

one or more antenna patch elements for radiating radio frequency (RF) signals, each of the one or more antenna patch elements comprising a conductive layer;

a circuit board disposed between the one or more antenna patch elements and a support structure; and the support structure comprising one or more ground cavities, the one or more ground cavities being integrated into the support structure and electrically conductive, the one or more ground cavities for resonating standing waves, the one or more ground cavities disposed below the respective one or more antenna patch elements, wherein the one or more antenna patch elements are capacitively coupled to the respective one or more ground cavities, wherein:

the support structure comprises a top surface and a bottom surface, the top surface facing toward the one or more antenna patch elements, the bottom surface facing away from the one or more antenna patch elements, the top surface comprises one or more first physical pockets, the one or more ground cavities comprise one or more conductive sheets, each of the one or more conductive sheets integrally attached to a respective one of the one or more first physical pockets and attached to a rim of the respective one of the one or more first physical pockets, the support structure further comprises one or more module cavities, a top conductive face sheet, and a bottom conductive face sheet, the top surface further comprises one or more second physical pockets, the one or more module cavities comprise one or more dielectric sheets, each of the one or more dielectric sheets integrally attached to a respective one of the one or more second physical pockets and attached to a rim of the respective one of the one or more second physical pockets, the top conductive face sheet is attached to the top surface, the top conductive face sheet not covering over the one or more dielectric sheets or the one or more conductive sheets, and the bottom conductive face sheet is attached to the bottom surface.

* * * * *